US005102245A

United States Patent [19]

Ikehata et al.

[11] Patent Number: 5,102,245

[45] Date of Patent: Apr. 7, 1992

[54] PRINT HEAD

[75] Inventors: Tsutomu Ikehata; Makoto Yasunaga, both of Saitama; Katsuya Masuda, Tokyo; Hirofumi Suzuki, Saitamaken, all of Japan

[73] Assignee: Citizen Watch Co., Ltd., Tokyo, Japan

[21] Appl. No.: 573,067

[22] Filed: Aug. 27, 1990

[30] Foreign Application Priority Data

Aug. 26, 1989 [JP] Japan ..... 1-99522
Sep. 11, 1989 [JP] Japan ..... 1-105344
Sep. 12, 1989 [JP] Japan ..... 1-106137

[51] Int. Cl.[5] ..... B41J 2/25
[52] U.S. Cl. ..... 400/124; 101/93.05
[58] Field of Search ..... 400/124; 101/93.05

[56] References Cited

U.S. PATENT DOCUMENTS 4,433,927 2/1984 Cavallari ..... 400/124
4,661,002 4/1987 Ara ..... 101/93.05
4,695,174 9/1987 Gugel et al. ..... 101/93.05
4,697,939 10/1987 Ara ..... 101/93.05
4,778,293 10/1988 Teshima et al. ..... 400/719
4,795,283 1/1989 Moriya et al. ..... 400/124
4,988,222 1/1991 Yamamoto et al. ..... 400/124

*Primary Examiner*—Edgar S. Burr
*Assistant Examiner*—Stephen R. Funk
*Attorney, Agent, or Firm*—Wenderoth, Lind & Ponack

[57] ABSTRACT

A print head for a dot printer having a plurality of needles for printing by projecting the needles selectively from the print head. The print head has a solenoid base having a plurality of solenoids arranged in a circle thereon for driving the needles, a heat conductor having one side fixed in heat conducting relationship to one surface of the solenoid base and having a heat radiating portion extending in one direction from the solenoid base for radiating heat conducted thereto from the solenoid base, and a connecting portion extending in another direction from the solenoid base, a printed circuit board mounted on the side of the heat conductor opposite the one side, and an electrical connector for receiving a cable for supplying signals to a circuit on the printed circuit board and mounted on the connecting portion and electrically connected to the circuit on the printed circuit board.

6 Claims, 3 Drawing Sheets

PRINT HEAD

The present invention relates to a print head of a dot printer for printing by projecting more than one needle selectively, and particularly to an improvement in such a print head in which a heat conductor contacting a solenoid base is contacted with a printed circuit through insulating material, to a mechanism for guiding static electricity which is generated by the printing to ground and a mechanism for mounting a thermal sensing element for detecting the temperature of solenoids in order to avoid seizure of the solenoids which are mounted in the solenoid base.

BACKGROUND OF THE INVENTION

A conventional print head of a dot printer is shown in Japanese Laid-Open Patent Application No. Sho 57-163579 dated Oct. 7, 1982.

This print head consists of a plurality of electromagnets supported on a reel which has a core and at least one winding having an electrical connecting pin, a printed circuit board fixed to the electromagnets by soldering, a connecting means for connecting the circuit board to an outside electrical-circuit, and an insulating plastic means for covering said electromagnets and printed circuit board other than at the connecting means.

This print head has a flat lug projecting outwardly from the printed circuit board, which is ring shaped and the connecting means is a connector fixed on said flat lug.

If a large force is applied to the printed circuit board when a cable is detached from or attached to the connector, wiring on the printed circuit board and the connecting pins may be broken from the base at the soldered junctions therebetween.

As force applied to the connector at the time of connecting or disconnecting the connector has to be received by the printed circuit board, the board must have a sufficient thickness for obtaining the necessary strength, If the connector is given a shock by falling during transport or assembling, it may be broken and the soldered portion may be displaced.

Another conventional print head is shown in Japanese Laid-Open Utility Model Application No. Sho 58-94529 dated June 27, 1983.

This print head consists of a plurality of needles, a nose for supporting a guide member for guiding said needles, and a plurality of iron core frames, on which needle driving coils are arranged circumferentially, and said iron core frames are each connected to the nose by means of a heat transmitting member.

This print head has a heat radiation member having many fins, and the iron core frame is fitted on the inside of the heat radiation member. The heat generated during the operation of the print head is conducted to the heat radiation member through a connection between the heat radiation member and the iron core frame. The heat is conducted from a cylindrical inner wall spaced from the bottom of the iron core frame mounted on the core which is a heat conducting path from the solenoid, which is a heat generator, to the inner wall of the heat radiation member. The connecting area between the heat radiation member and iron core frame is determined by the connecting pressure.

Therefore, the heat conducting efficiency is poor thus, this print head is conducts in that the generated heat the outside poorly.

Another conventional print head for a printer is shown in Japanese Laid-Open Utility Model Application No. Sho 60-38757, dated Mar. 18, 1985. This print head has more than one circuit pattern. One of said circuit patterns is a grounding circuit. The grounding circuit has a conductive material leaf on one end thereof for collecting static electricity. The conductive material leaf of the flexible printed circuit is contacted with a back surface of the print head, but the contacting pressure is insufficient and unstable. Therefore, static electricity generated on the paper being printed collects on the print head. This static electricity causes wrong motions of the needles.

Another conventional print head for a printer is shown in Japanese Laid-Open Utility Model Application No. Sho 63-21035 dated Feb. 12, 1988. This print head has a thermal sensing mechanism. The mechanism as described has thermal sensing elements mounted on the outer periphery of the solenoid base. Terminals of the thermal sensing elements are fixed to the base.

This conventional print head has defects as follows:

Firstly, the temperature difference between the solenoid and each thermal sensing element is great. Heat from the solenoid is conducted to the outer periphery, of the base from the core through the bottom surface of the solenoid base. The temperature difference between the solenoid and thermal sensing element may become great.

If the mechanism for mounting the thermal sensing element does not have a heat sink for cooling the print head, the sensing element is cooled by being exposed to the air directly. Therefore, the proper temperature of the solenoid cannot be detected.

OBJECTS AND BRIEF SUMMARY OF THE INVENTION

It is an object of the present invention to provide a print head having good impact resistant properties and high heat radiation efficiency.

A further object of the present invention is to provide a print head which is able to carry out proper printing without being affected by static electricity.

Another object of the present invention is to provide a print head in which the temperature difference between the solenoid and a thermal sensing element is small, the position of the thermal sensing element is stable, and which can be assembled automatically.

The first object of the present invention is achieved by a print head in which heat conducting material has all the following functions, namely, a high heat radiation function for radiating heat from the solenoid base efficiently, a heat conducting function for conducting heat to the carriage, and a protecting function for protecting the printed circuit and the connector for connecting a cable thereto.

The second object of the present invention is achieved by a print head in which pins are pressed into holes in the solenoid base and heat conductor and are fixed together, and these pins are soldered to a grounded conducting pattern on the printed circuit for avoiding building of static electricity.

The third object of the present invention is achieved by a print head in which the thermal sensing element is mounted between the base and the printed circuit.

BRIEF DESCRIPTION OF THE DRAWINGS

The invention will become clear from the following detailed description taken together with the accompanying drawings, in which.

DETAILED DESCRIPTION OF THE INVENTION

A preferred embodiment of the print head for achieving said first and second objects of the invention is shown in FIGS. 1–4.

The print head has an armature unit 1, a solenoid unit 2, and a nose unit 3.

The solenoid unit 2 is positioned between the armature unit 1 and the nose unit 3.

Figure 3:
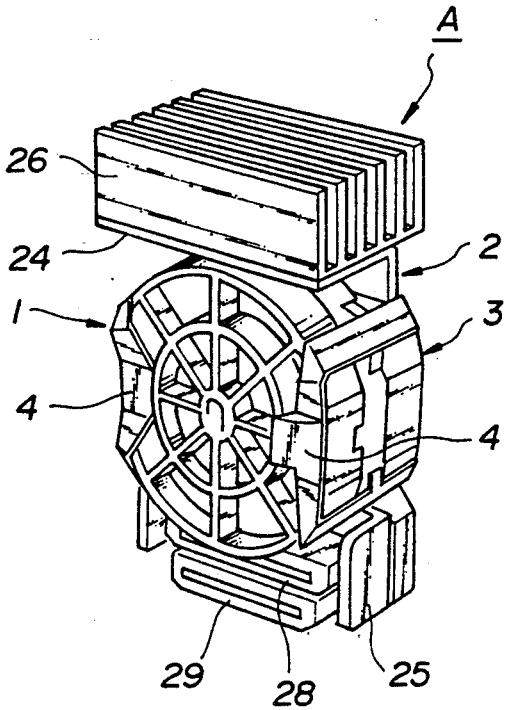
FIG. 3 is a perspective view of the print head of FIG. 1.

These three units and a heat conductor 15, are connected by fixing bands 4 as shown in FIG. 3 into a print head A.

The armature unit 1 consists of an armature base 5 having reinforcing ribs on the rear surface, a plurality of armatures 6 arranged in a circle on the front of the armature base 5 and an armature spring 7 mounted between each armature 6 and armature base 5. On the center of the armature base 5 is mounted an armature stopper 8 determining the waiting position of the armature 6. A positioning projection 9 is provided for positioning each armature 6 on the outside of the armature base 5.

The solenoid unit 2 consists of a cup-shaped solenoid base 10 and a plurality of electromagnetic driving apparatuses 11 arranged in a circle on the rear surface of the solenoid base 10 unit are opposite each armature 6. Each electromagnetic driving apparatus 11 has a core 12 integral with the solenoid base 10, a bobbin 13 fitted on the outside of the core 12 and a solenoid 24 wound on the bobbin 13.

On the opposite side of the solenoid unit from the armature unit 1 is mounted the nose unit 3. An electrically conductive heat conductor 15, and insulator 16 and a print circuit board 17 are mounted between the solenoid unit 2 and the nose unit 3. The nose unit 3 has a nose 19 having a cylindrical portion 18 extending from the center thereof into a center hole in the solenoid base 10 and a plurality of needles 20 one for each of the armatures 6, which are guided slidably in the nose 19. Each needle 20 has a needle pin 21 at the rear end thereof which contacts the corresponding armature 6. A return spring 22 is provided around each needle for pressing the needle 20 against the corresponding armature 6 and retracting the tip of the needle 20 to the front of the nose 19.

Figure 2:
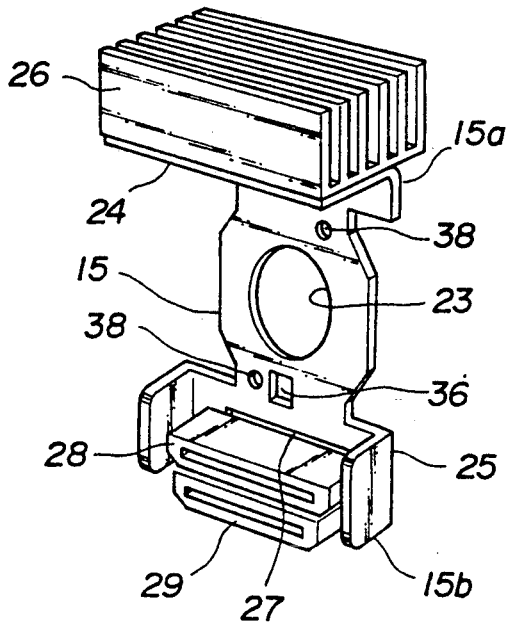
FIG. 2 is a perspective view for showing an example of a heat conductor forming part of the print head according to the present invention.

The heat conductor 15 has a pair of projecting portions **15*a*, 15*b* projecting outward respectively as shown in FIG. 2**.

The heat conductor 15 has a hole 23 in the center portion through which the cylindrical portion 18 of the nose unit 3 extends.

A first projecting portion **15*a* of the heat conductor 15 is bent so as to be generally perpendicular to the center portion to form a heat radiating end 24 and a second projecting portion 25** having a U-shape.

A heat sink 26 having a plurality of heat radiating fins is mounted on the heat radiating end 24 for forming a heat radiating portion in order to radiate heat into the air. Alternatively this heat sink 26 may be formed integrally with the heat conductor 15 by extrusion molding as shown at **26*a* in FIG. 5**.

A cutout 27 is formed in the lower portion of the connecting portion 25. Two connectors 28 and 29 for receiving the ends of signal cables are mounted over the cutout 27. The ends of the connectors 28 and 29 are joined to the projecting portion **15*b* at the cutout 27 and connecting pins 40 from each of the connectors 28 and 29 are extended through the cutout 27 into terminal holes in the printed circuit board 17** and are soldered to a part of a circuit formed on the circuit board.

Figure 1:
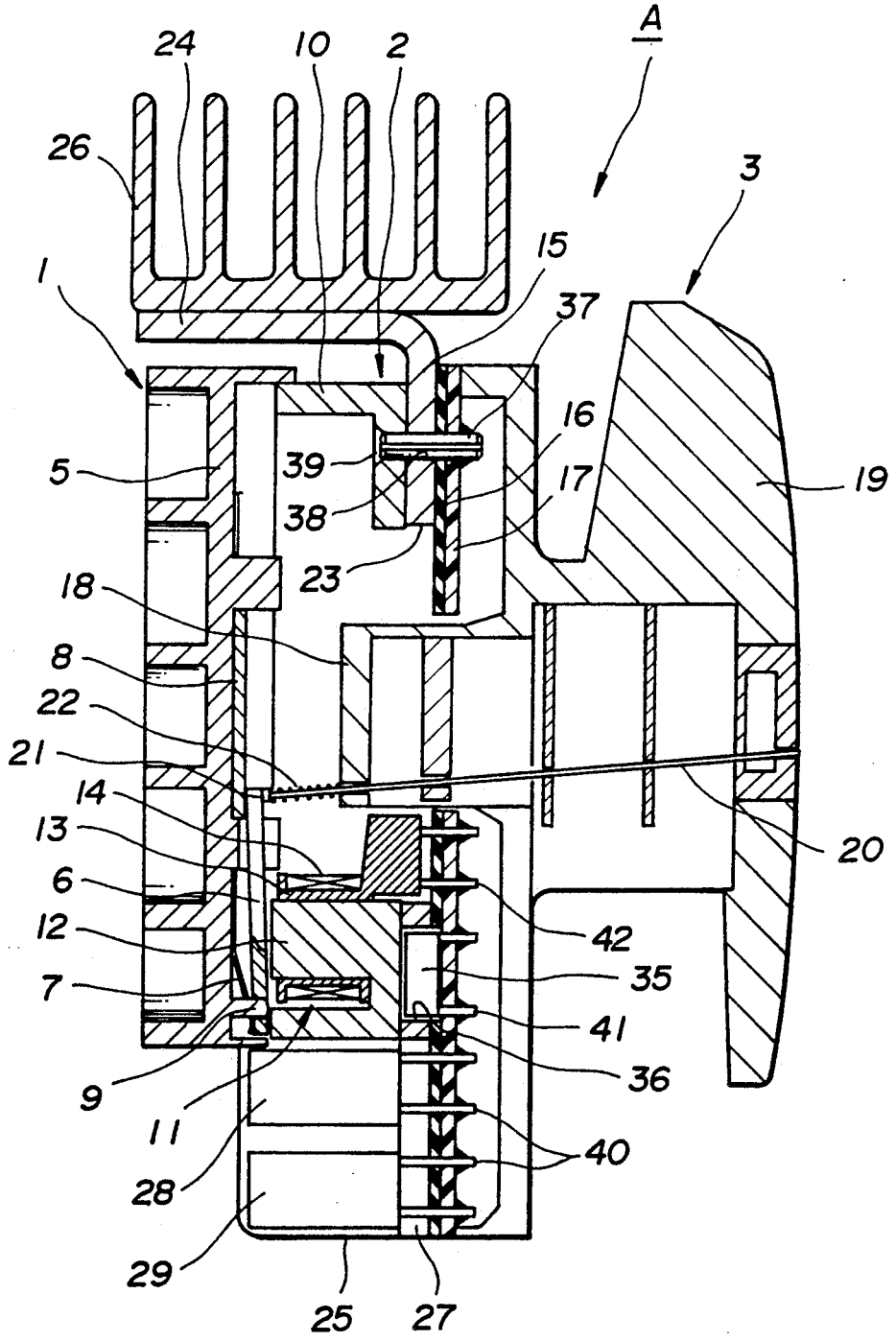
FIG. 1 is a sectional view of an embodiment of a print head according to the present invention.

As shown in FIGS. 1 and 2, the heat conductor 15 has a hole 36 for receiving a thermal sensing element 35 such as a thermistor, and a pin hole 38 for receiving an electrical conductive spring pin 37. The hole 36 can be formed in any part of the heat conductor 15 and insulator 16. The spring pin 37 is pressed into the solenoid base 10 and heat conductor 15, and extends through the printed circuit board 17 and is soldered to a part of a circuit formed on the circuit board 17. Thus, the insulator 16 and printed circuit board 17 are fixed to the solenoid base 10. Connecting pins 41 of the thermal sensing element 35 and connecting pins 42 for the solenoids 14, are inserted in the printed circuit board 17 and soldered to a part of the circuit formed on the circuit board.

Figure 4:
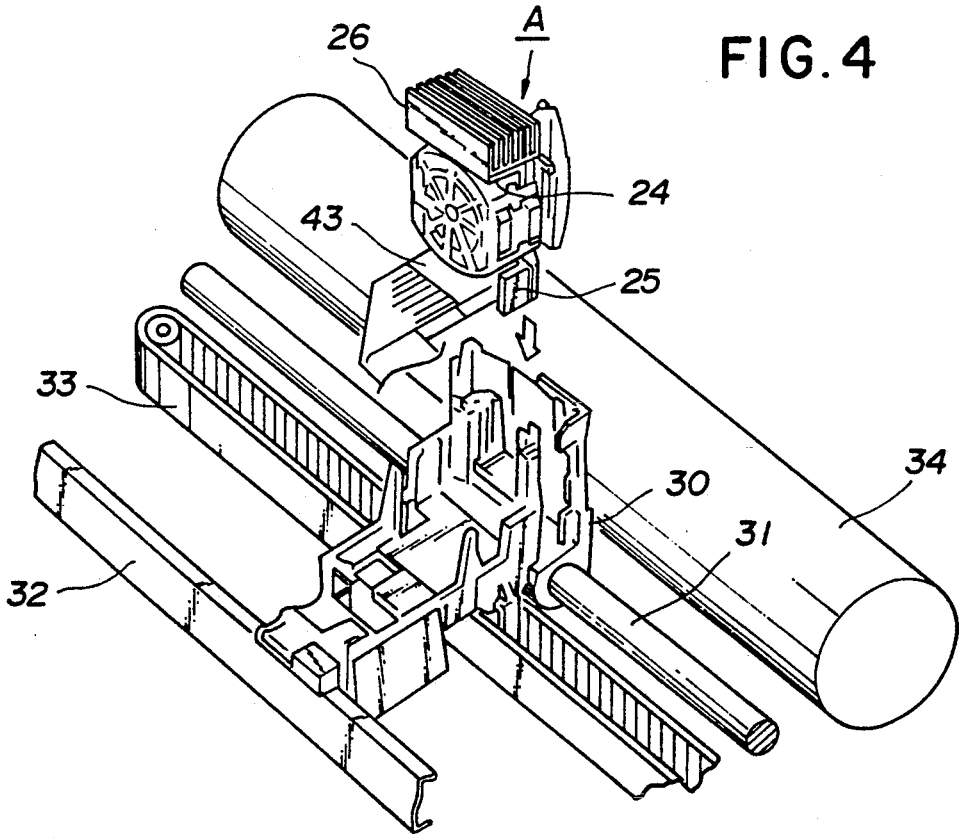
FIG. 4 is a perspective view showing the print head being mounted in a printer carriage.

The connecting portion 25 is attachable to and detachable from the carriage so as to mount the print head on and remove it from the carriage 30 as shown in FIG. 4.

When the connecting portion 25 is attached, it will conduct heat to the carriage 30 because it is engaged with the carriage 30 closely over a wide area, and also it functions as a conductor for flow of static electricity collecting on the print head A to ground.

As shown in FIG. 4, a carriage shaft 31 extends through the front of the carriage 30 for slidably supporting the carriage 30. A carriage guide frame 32 slidably supports the rear portion of the carriage 30. An endless timing belt 33 moves the carriage 30 reciprocally.

A platen 34 is positioned in front of the carriage 30.

A cable 43 for transmitting printing information is plugged into connectors 28 and 29.

Figure 5:
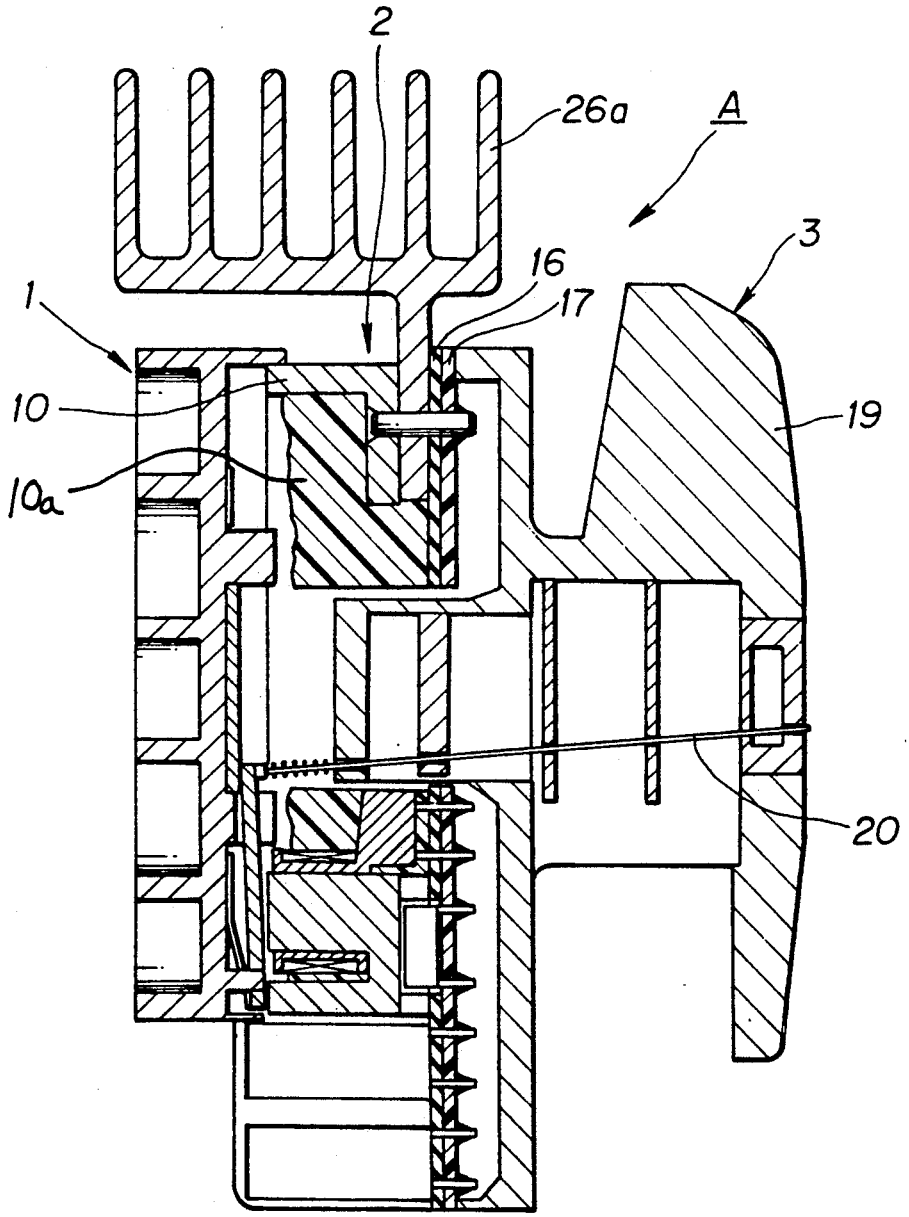
FIG. 5 is a sectional view of another embodiment of the print head according to the present invention.

The embodiment shown in FIG. 5 provides synthetic resin **10*a* filling the space within the solenoid base 10 other than around the needles 20**.

The assembly and operation of the present embodiment will be described.

In the print head the heat conductor 15 is pressed tightly against the solenoid base 10. Through the heat sink 26 formed on the heat radiating end 24, heat from the solenoids 14 which are heat generating sources is radiated efficiently to the air.

The print head A is mounted and fixed in place on the carriage 30 by inserting the connecting portion into the carriage 30.

The carriage 30 has a hollow for receiving the connecting portion 25 of the print head A. The connecting portion 25 having the U-shape engages with a surface of the hollow to provide a broad contact area between the heat conductor 15 and carriage 30. Cable 43 is then inserted into the connectors 28, 29 as shown in FIG. 4.

Because the connecting portion 25 is U-shaped and the connectors 28 an 29 are positioned inside the U-shaped portion, damage to the connectors during transporting and assembling of the print head will be prevented.

Also, because connectors 28 and 29 are mounted on the heat conductor 15, the force for inserting the cable 43 into the connectors 28 and 29 is received by the heat conductor 15, which is different from the conventional print head in which the connector is mounted directly on the printed circuit board. Because the force is not applied to the circuit board 17, release of the soldering connection and breaking of a wire which may be caused by bending of the circuit board 17 at the time of inserting the cable is prevented.

In operation, when the print head A is reciprocally driven with the carriage 30, the armatures 6 are energized by on-off operation of the electromagnetic driving apparatus 11 and the needles 20 move forward and retract against the action of the return spring 22. By this motion of the needles 20, dotted patterns are provided on paper on the front of the platen 34 through an ink ribbon (not shown) which is supported in front of the needle 20.

During the printing, heat is generated in the solenoids 14 by on-off operation of the electromagnetic driving apparatus 11. This heat is conducted to the solenoid base 10 through the cores 12 from the bobbins 13. The heat conducted to the solenoid base is conducted to the heat conductor 15 through a broad connecting area.

A part of the heat conducted to the heat conductor 15 is conducted to the heat sink 26 from the heat radiating end 24 mounted on the projecting portion 15*a* and radiated from the heat sink 26 to the air. The remainder of the heat is conducted to the carriage 30 through the connecting portion 25 of the other projecting portion 15*b*. The heat conducted to the carriage 30 is conducted to a printer body (not shown) through the carriage shaft 31 and carriage guide frame 32 and radiated to the air. Therefore, a part of heat generated by the electromagnetic driving apparatus 11 is conducted to the heat sink 26 which is integral with the heat conductor 15 and the remaining part of the heat is conducted to the carriage 30 through a broad contact area with the connecting portion 25.

Because heat is conducted to the outside efficiently, it will prevent a temperature rise of the solenoid base 10.

During the printing, static electricity collecting on the print head A is conducted to ground through the carriage 30 and the carriage shaft 31 from the connecting portion 25 of the heat conductor 15. Also static electricity generated on the print paper during the printing is conducted to the solenoid base 10 through the needles 20 and then to ground through heat conductor 15. The ground circuit of the circuit or circuit board 17 is also connected to heat conductor 15 through the spring pin 37.

Because static electricity does not collect in the print head A, wrong motions caused by the static electricity can be prevented efficiently.

The circuit board 17, heat conductor 15 and solenoid base 10 are assembled by pressing one end of the spring pin 37 into the pin hole 38 of the heat conductor 15 and the pin hole 39 of the solenoid base 10 and soldering the other end of the spring pin 37 which extends through the insulator 16 and circuit board 17 to the ground circuit on the circuit board.

In this case, the circuit board 17 is held in place against the heat conductor 15 and solenoid base 10 simply by inserting the spring pin 37 into the pin holes 38 and 39. Therefore, the parts may be assembled with high precision.

Because the spring pin 37 can be deformed easily due to the elasticity, it may be pressed into the pin holes 38 and 39 easily, the assembly is easy and the parts are fixed securely. Moreover, the outer peripheral surface of the spring pin 37 is pressed tightly against the inner peripheral surface of the pin holes 38 and 39. Therefore, there is no gap which will collect static electricity.

In this embodiment, the thermal sensing element 35 is mounted at a position at which heat of the solenoid base 10 is conducted to the heat conductor 15. Therefore, thermal sensing efficiency is excellent and also any temperature difference between the solenoids and the thermal sensing element is small. Because the connector pins 41 of the thermal sensing element 35 have a short length, the positions of the thermal sensing elements 35 are uniform regardless of the products.

Because the solenoid base 10 is mounted on the opposite side of the heat conductor 15 from the circuit board 17 carrying the thermal sensing element 35, this print head can be assembled automatically.

Because thermal sensing element 35 is positioned between the solenoid base 10 and the circuit board 17, it is not cooled directly by the outside air. Therefore, it is able to properly detect the temperature of the solenoids 14 without being influenced by the outside temperature. It will therefore sense the highest temperature of the solenoids. It is also desirable that the thermal sensing element 35 be mounted close to the core 12 for the solenoids which are operated frequently when printing frequency is high.

The invention is not limited to one thermal sensing element 35. More than one may be provided.

We claim:

1. A print head for a dot printer having a plurality of needles for printing by projecting the needles selectively from said print head, comprising:

a solenoid base having a plurality of solenoids arranged in a circle thereon for driving the needles;

a heat conductor having one side fixed in heat conducting relationship to one surface of said solenoid base and having a heat radiating portion extending in one direction from said solenoid base for radiating heat conducted thereto from said solenoid base, and a connecting portion extending in another direction from said solenoid base;

a printed circuit board mounted on a side of said heat conductor opposite said one side; and electrical connector means having at least one connector having pins extending through said heat conductor and said circuit board, and soldered to a circuit on said circuit board for receiving a cable for supplying signals to the circuit on said printed circuit board, said electrical connector means being mounted on said connecting portion.

2. A print head as claimed in claim 1 in which said heat conductor has a hole therein and said solenoid base has a hole therein aligned with said hole in said heat conductor, and a pin fixed in said hole in said solenoid base and extending through said hole in said heat conductor and soldered to said printed circuit board for holding said solenoid base, said heat conductor and said printed circuit board in the assembled condition.

3. A print head as claimed in claim 1 further comprising a thermal sensing element between said printed circuit board and said solenoid base, and mounted on said printed circuit board and electrically connected to a circuit on said printed circuit board.

4. A print head as claimed in claim 3 in which said heat conductor is made of heat conductive material and has an aperture therethrough through which said thermal sensing element extends, said heat conductor surrounding said thermal sensing element for keeping the thermal sensing element at a temperature close to the solenoid base.

5. A print head as claimed in claim 1 in which said heat conductor has projecting portions surrounding said at least one connector on at least two sides.

6. A print head as claimed in claim 1 in which said heat conductor is made of an electrically conductive material and further comprising an electrically conductive pin in said solenoid base extending through said heat conductor in electrically conductive relation therewith and soldered to a ground circuit on said circuit board, and said connecting portion having a portion thereon for mating with an electrically conductive receiving recess on a carriage of the printer, whereby static electricity from said print head and ground current from the circuit on said printed circuit board are conducted out of said print head through said heat conductor to the carriage of the printer.

* * * * *